US005147279A

United States Patent [19]

Granger

[11] Patent Number: 5,147,279

[45] Date of Patent: Sep. 15, 1992

[54] DEVICE DESTINED TO AUTOMATICALLY DISPENSE WIPING MATERIALS OF A CONCERTINA FORM CONSISTING OF ROLLED UP STRIPS

[76] Inventor: Maurice Granger, 17 rue Marcel Pagnol, 42270 Saint Priest En Jarez, France

[21] Appl. No.: 641,723

[22] Filed: Jan. 15, 1991

Related U.S. Application Data

[62] Division of Ser. No. 224,408, Jul. 26, 1988, Pat. No. 5,013,291.

[30] Foreign Application Priority Data

Apr. 26, 1988 [FR] France ..... 88 05939
Jun. 6, 1988 [FR] France ..... 88 07823

[51] Int. Cl.[5] ..... B31F 1/00

[52] U.S. Cl. ..... 493/448; 493/357; 270/40

[58] Field of Search ..... 493/356, 357, 439, 440, 493/443, 448; 83/333, 385, 387, 660; 225/103; 270/40

[56] References Cited

U.S. PATENT DOCUMENTS 3,038,718 6/1962 Balsam ..... 270/40
3,348,458 10/1967 Tipper ..... 93/84 R
3,935,802 2/1976 Perrin et al. ..... 93/84 R

*Primary Examiner*—Robert P. Olszewski
*Assistant Examiner*—Kenneth Noland
*Attorney, Agent, or Firm*—Eric P. Schellin

[57] ABSTRACT

A dispenser for dispensing discrete lengths of longitudinally corrugated strips of wiping web material from a source of uncorrugated continuous length wiping material. In the device the web material is payed through and between converging longitudinally disposed projections whereby the corrugations are formed. The corrugated web is then fed between cogwheels, then to an egress part of the dispenser through which the web projects for a distance. The cogwheels may be provided with a severing means. To dispense the web projecting from the dispenser it is pulled outwardly resulting in obtaining a desired severed length of wiping material.

5 Claims, 10 Drawing Sheets

FIG. 3
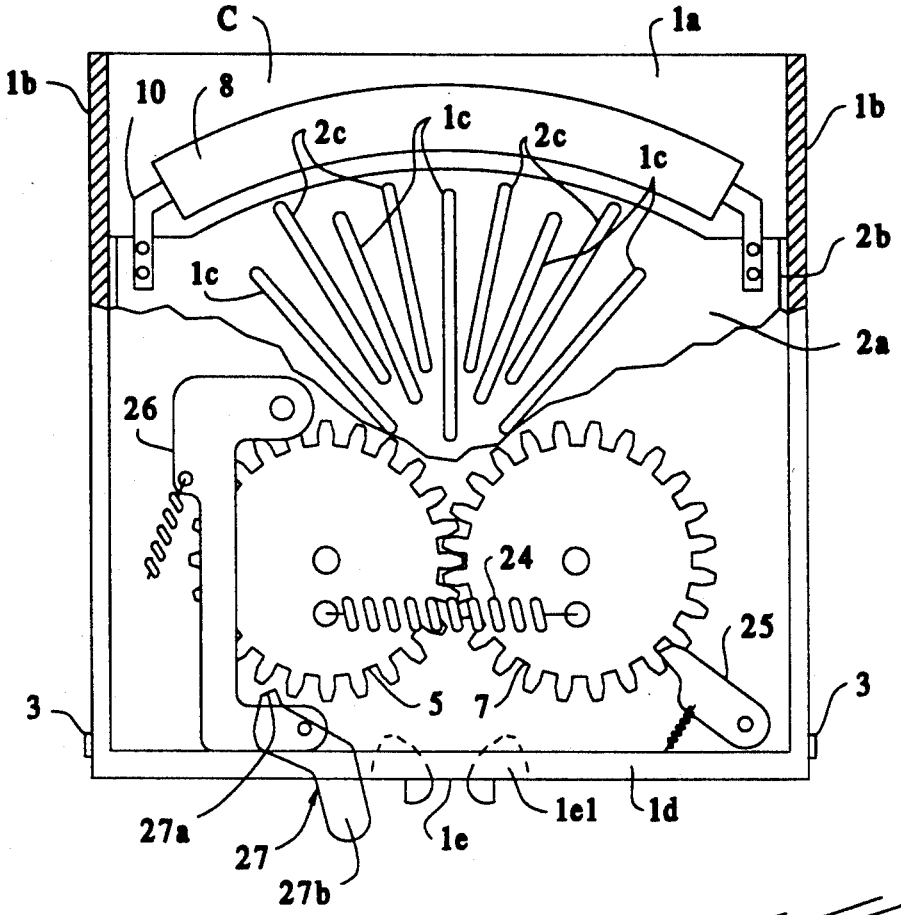
FIG. 4
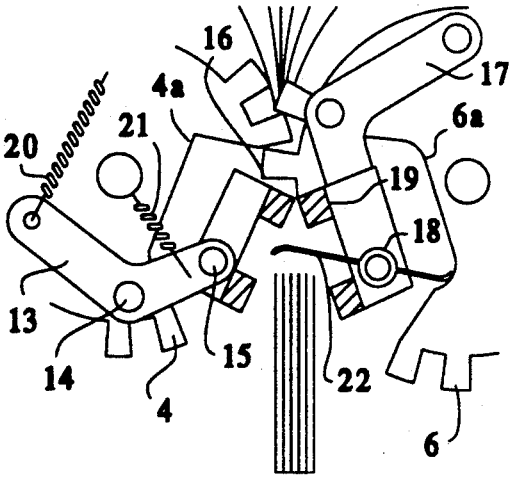
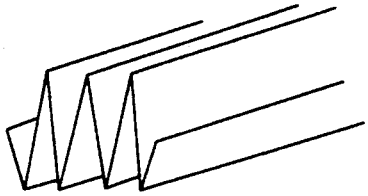
FIG. 8
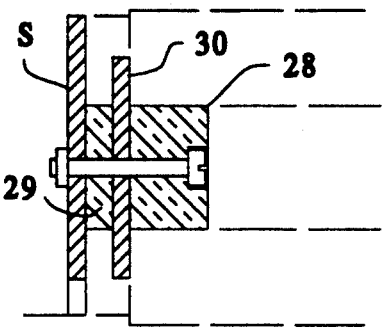
FIG. 7

FIG. 4A
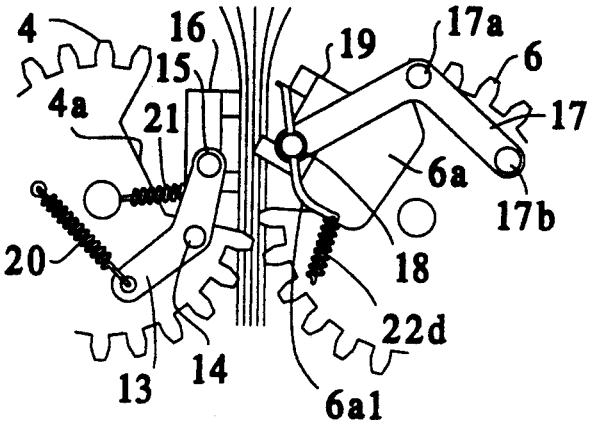
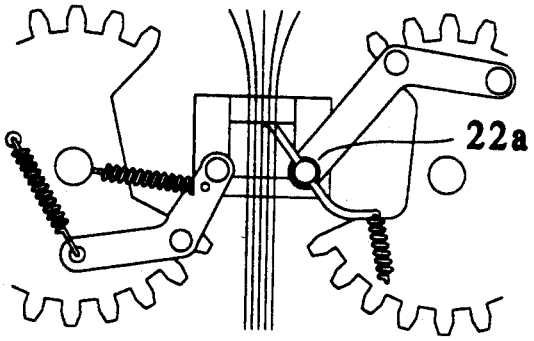
FIG. 4B
FIG. 4C
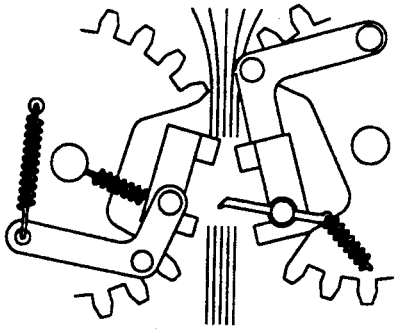

FIG.12
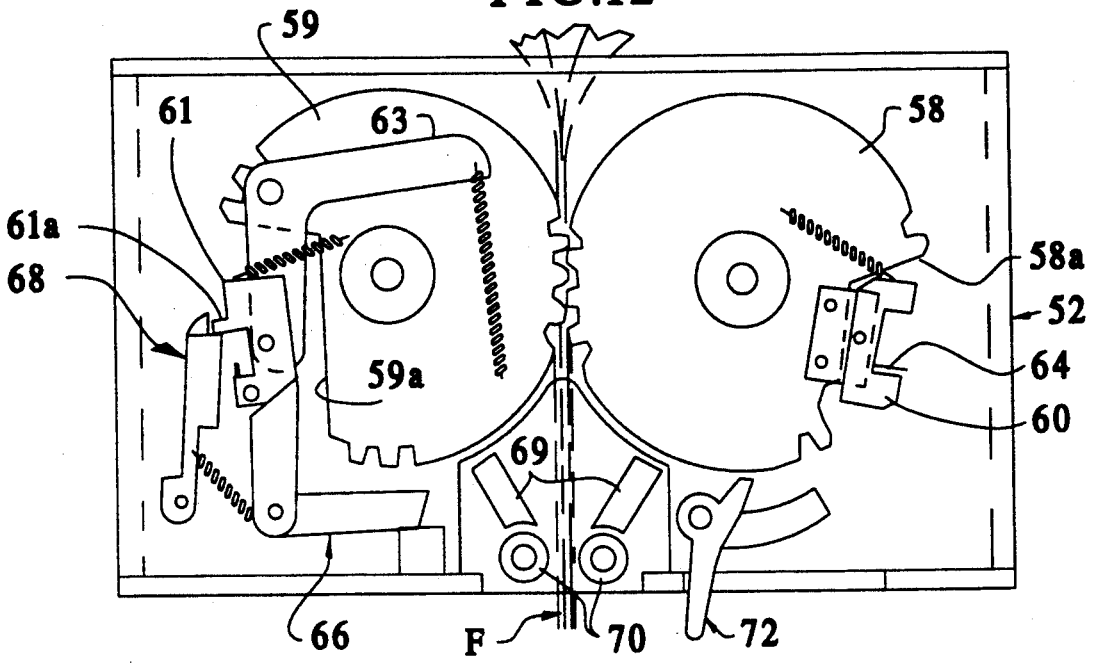
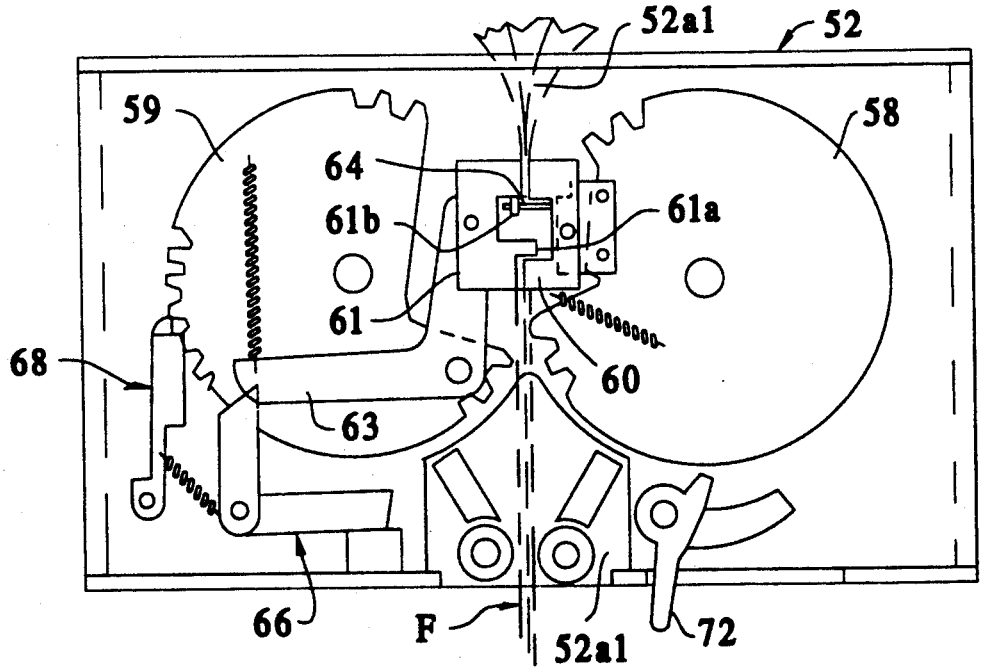
FIG.13

FIG.14
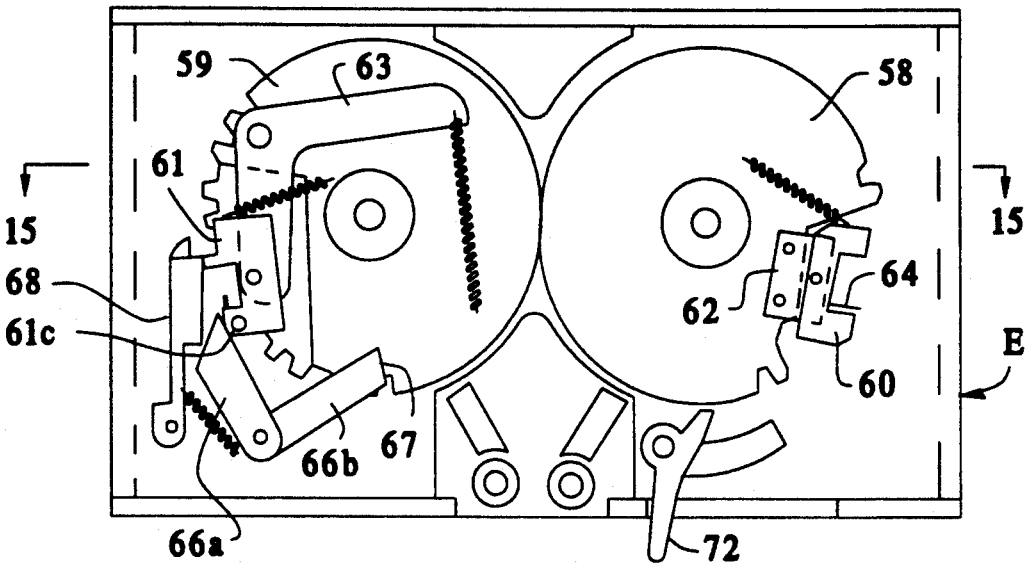
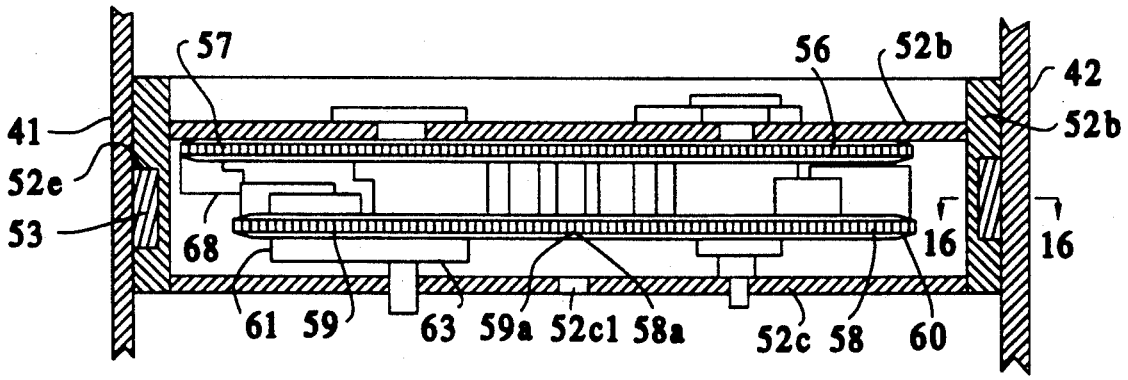
FIG.15
FIG.16
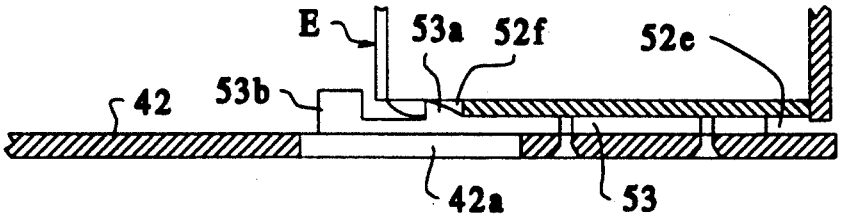

DEVICE DESTINED TO AUTOMATICALLY DISPENSE WIPING MATERIALS OF A CONCERTINA FORM CONSISTING OF ROLLED UP STRIPS

This application is a division of application Ser. No. 07/224,408, filed Jul. 26, 1988, now U.S. Pat. No. 5,013,291.

BACKGROUND OF THE INVENTION

Dispensers are known which are designed to either automatically or non-automatically dispense lengths of wiping materials in public or private toilets. Such devices employ various materials: paper, cotton wool, non-woven materials all of which are somewhat absorbent. It has become customary to fabricate such materials whereby they are webs of thinner and thinner and concomitantly more and more fragile.

Problems arise as the sheets of wiping materials become thin, they do not tear at their respective kiss die cuts.

In order to overcome such a problem the present application discloses an apparatus which advantageously can dispense lengths of the thinnest wiping materials.

SUMMARY OF THE INVENTION

With this in mind and according to a first embodiment, the device of the present invention is fitted with means to dispense discrete longitudinally folded webs or strips of wiping material from a roll of material. Means is provided to longitudinally fold the wiping material and means is provided to at least partially sever the wiping material into discrete lengths as the wiping material is manually pulled through a dispensing orifice.

In another embodiment the wiping material consists of a stock of manifolded material which is payed out of the dispenser in essentially the same manner as the wiping material on the roll.

Another feature resides in the fact that the apparatus has a cutting means that track and drive the said strip, automatically or non-automatically operatively when a pre-determined length of strip has been pulled out of the said orifice.

As was stated the strip of wiping material as it is payed may be either from a reel or from a pile of manifolded material.

The elongated strip of web material as it is payed is passed between a plurality of spaced projections positioned in the device longitudinal with respect to said payed wiping material. One set of the projections is mounted on a relatively fixed surface. The second set is mounted on a relatively movable surface. The two sets are adapted to interleave and therewith carry the wiping material. The projections all converge whereby the result is a strip of corrugated web material which is subsequently fed to a tracking and driving means through which the strip material is fed.

Furthermore the tracking and driving means for the corrugated strip is constructed of two cogwheels freely rotatable in corrugated strip receiving position whereby the cogwheels mesh but have sufficient space therebetween whereby the corrugated strip material can pass therebetween. The cogwheels rotate when the corrugated strip material is pulled as it passes between the cogwheels.

The elongated uncorrugated strip material is unrolled from the reel or, in the case of the manifolded pile, is payed therefrom over an arcuate roller means to describe a cross-sectional arc to thereby preorient the strip material which is then directed to be interleaved between the said projections whereby the strip material converged in the direction of the cogwheels. In order to avoid the payed off strip material from being prematurely torn when it is pulled by the end portion thereof projecting from the device, the roller means is resiliently mounted.

In order to load the device with a new reel of wiping material and to make sure it projects properly from the orifice of the device ready to be pulled from the dispenser, one of the cogwheels is rotated by an auxiliary device, preferably accessible form the outside of the dispenser.

The length of the discrete corrugated and dispensed strip by the dispenser is substantially the same as the circumference of the cogwheel when a cutting means is combined with the said cogwheels. By varying the circumference of the cogwheels it is possible to vary the length of the discrete length of strip dispensed.

With this in mind, the tracking means and cutting means may be are designed in the form of a set of interchangeable cartridges with cogwheels of different diameters and thereby different circumferences. These interchangeable cartridges contain all the elements required for tracking, driving and cutting the corrugated strips, i.e. the set of cogwheels, a set of intermeshing gears, the support jaws and counter support with the cutting component and their connecting components with cogwheels, the manual loading device of the unit and the stopping and non-return components of the cogwheels; the said cartridges being engaged by guiding sliding on a fixing support of the dispenser and locked into position by any operational means.

According to another feature, the gears at the rear have smaller modules than the cogwheels with recesses, formed by missing teeth thereof at the front whereby to position support jaws and counter support so that the gears operatively mesh together without backlash, whereas the cogwheels mesh with regular backlash enables the corrugated strip to interleaving pass therebetween.

Other features are found in the fact that that the pinked cutting blade may be fixed to the side of the support jaw, resiliently hinged on one of the cogwheels and a counter support jaw is also resiliently hinged on to the other cogwheel, the bottom inside part has a projection to push the corrugated strip inside the support jaw and the top inside part has separation in the middle maintaining the strip between the teeth of the cutting blade.

BRIEF DESCRIPTION OF THE DRAWINGS

FIG. 3 is a rear view in partial cross section depicting the dispenser in a closed position;

FIG. 4 is a detailed view on a layer scale and in a cross section showing a cutting blade assembly and its operation according to a first embodiment;

FIGS. 4A, 4B and 4C are like FIG. 4 but showing various stages of the cutting sequences;

FIG. 7 is a detailed cross section showing the roll of material on a support.

FIG. 8 is a perspective view illustrating folding of the strip of material obtained from the dispenser;

FIGS. 12, 13 and 14 are front views respectively illustrating the interchangeable cartridge in the at rest position at the beginning of the cutting operation of the strip and before the non-return locking operation;

FIG. 15 is a cross section taken along lines 15—15 of FIG. 14;

FIG. 16 is a partial cross section taken along lines 16—16 of FIG. 15.

DETAILED DESCRIPTION OF THE INVENTION

Figure 1:
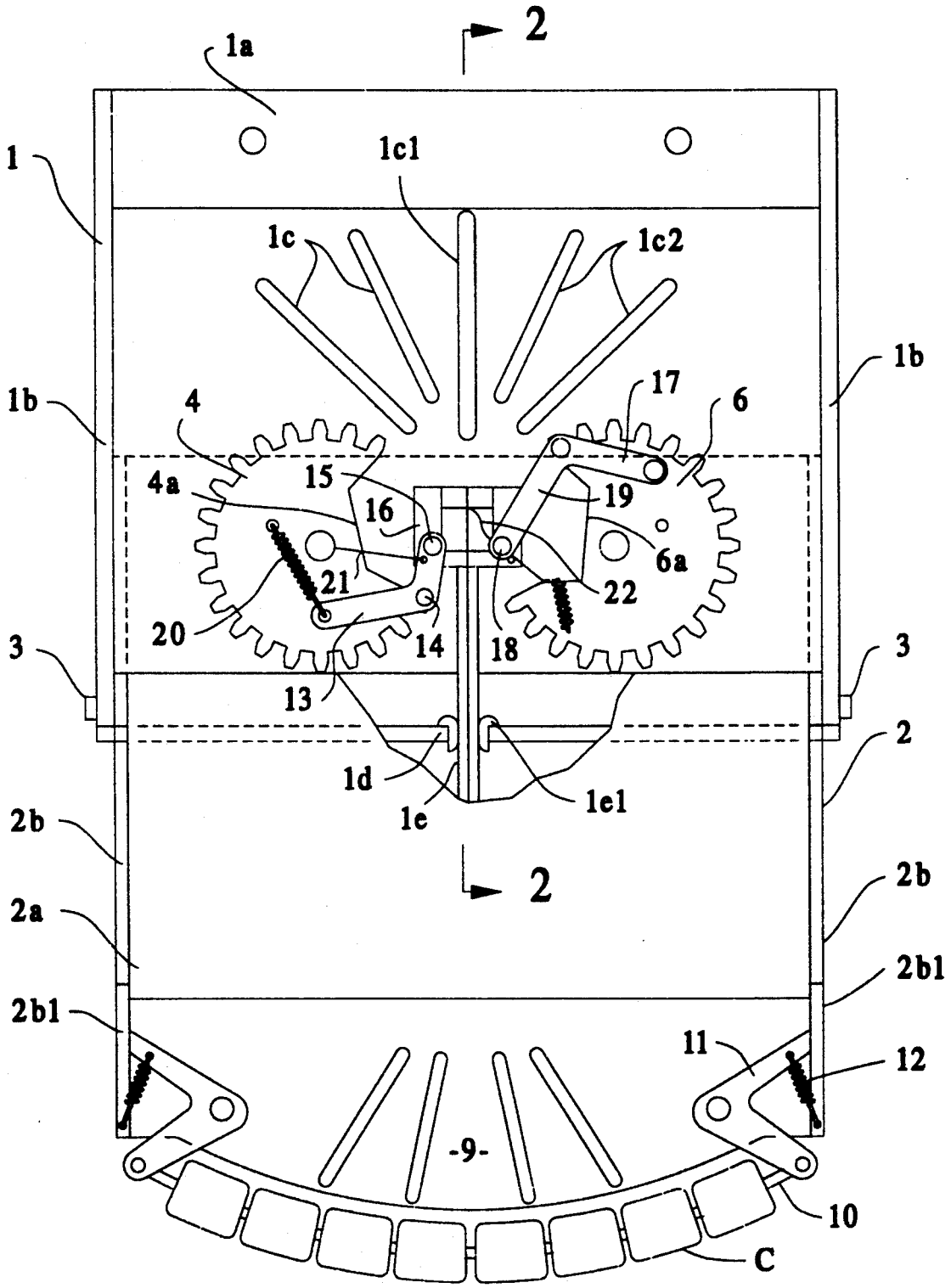
FIG. 1 is a front view illustrating the dispenser according to the invention with the housing removed and in the open position.

The device illustrated includes a fixed part 1 designed so as to hang on a vertical support such as a wall and a part 2 being connected to affixed part 1 by a hinge 3 at the lower portion of fixed part 1. A closing lid (not shown) covers both fixed part 1 and hinged part 2 to define a housing.

The fixed part 1 includes a bottom plate 1*a* which slopes downwardly outwardly and also includes two triangular shaped support legs 1*b* each defining a side wall. The bottom plate 1*a* and the support legs 1*b* together define a rear area for the mechanisms of the present invention.

At its top surface the plate 1*a* has several (five, for example) perpendicular elongated spaced projections 1*c* positioned at regular intervals to define a fan configuration, i.e. one central vertical oriented projection 1c1 and a plurality of sloping projections 1c2 each side extending from the outside towards the center thereby converging together in a direction towards tracking and drive means for the strip of web material. The tracking and drive means including either two cogwheels or a set of cogwheels 4,6 and gears 5,7 (see FIG. 3) freely rotatable and suitably journalled to the bottom plate 1*a*; the cogwheels intermeshing while at the same time leaving sufficient space to permit the passage therebetween a formed strip of corrugated web material.

The bottom part 1*a* possesses a disposed wall 1*d* which connects said side legs 1*b*. The said wall 1*d* has an intermediate opening portion 1*e* to permit the strip of corrugated web material to pass therethrough. It is pointed out that the opening 1*e* is profiled with wide rounded off surfaces 1e1 so the said strip of corrugated material passes easily therethrough.

The said hinged part 2 includes an offset wall 2*a* and two side legs 2*b* whose respective end portion is hingedly secured through hinge 3 to the bottom plate 1*a*.

Each of the side legs 2*b* has an extending support S for freely rotatable conventional core means for a roll R of web material to be dispensed.

Figure 2:
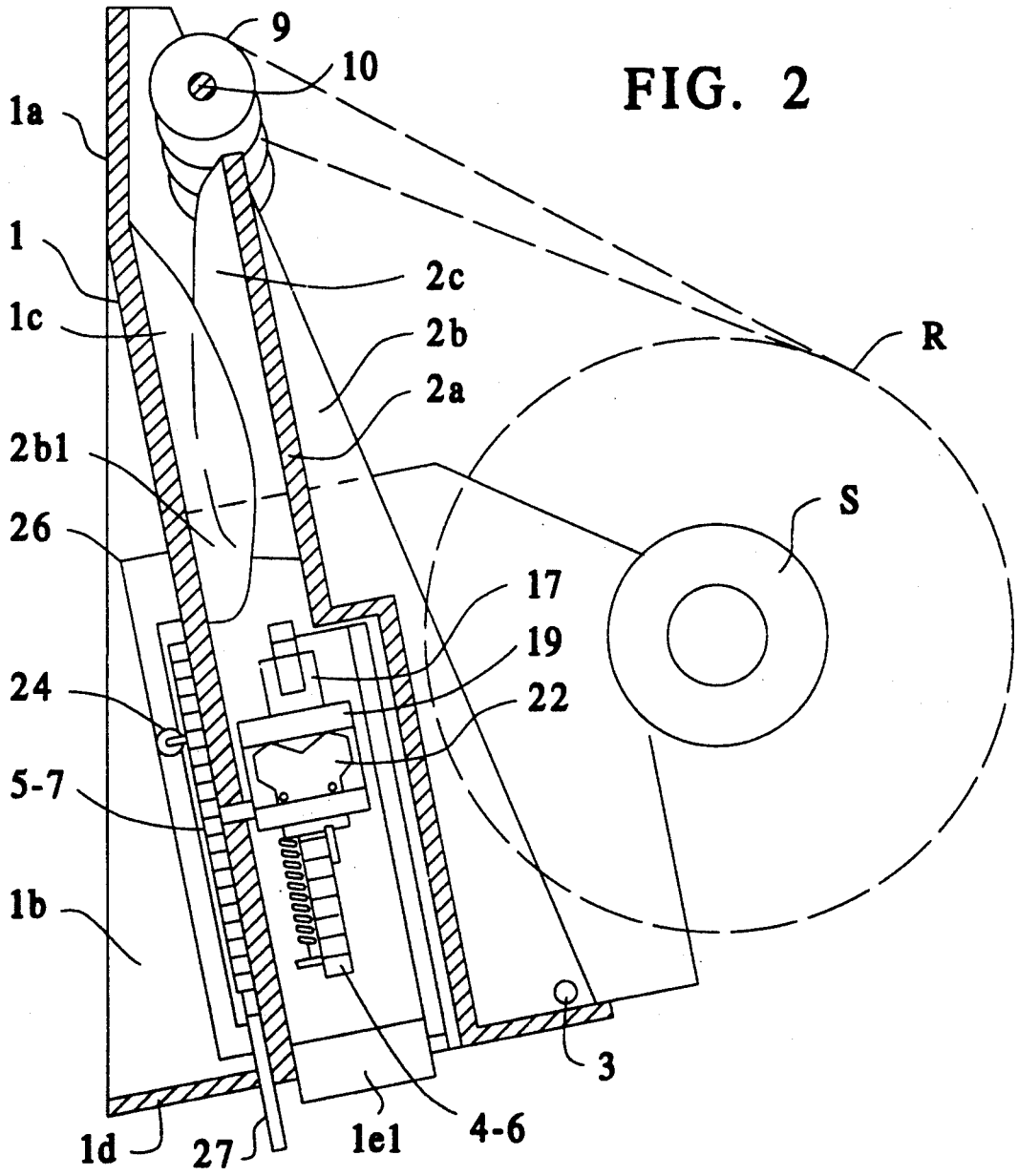
FIG. 2 is a cross-section taken on the line 2—2 of FIG. 1 depicting the dispenser in a closed position.

The said offset wall 2*a* at the end portion opposite the hinge 3 and at the opposite side to the roll carrying side, includes a plurality of spaced projections 2*c*, (four for example), similarly as the projections 1*c*. These projections 2*c* are positioned between the projections 1*c* when the dispenser is in operative position as in FIGS. 2 and 3.

It will be noted that both sets of projections 1*c* and 2*c* define a convex profile over their respective lengths. The edge portions thereof are also rounded to enhance the introduction and movement of the web material therebetween.

At the end opposite the hinge 3, the offset wall 2*a* may have an arcuate idler roller means C for the unrolled strip of web material prior to its passage between the said projections. These means can be a simple bulge formed in the offset wall 2*a* or as exemplified in FIGS. 1 and 3 by a built up component made up of either a bent tube B or a series of small rollers 9 which freely rotate on an arcuate axle 10 the respective ends of which may be directly integral or built up with the offset wall 2*a*.

In order to minimize tearing of the unrolled strip of material when it is pulled manually through the interleaved projections, the idler means C is preferably provided with means whereby said means C is resilient or otherwise yields and tends to return to its original position. To accomplish this, the said bulge or the said axle and rollers can be constructed of flexible material (see FIG. 3) or the axle and rollers can be operatively affixed to one end of pivotably mounted levers 11. The other end of said being spring loaded as can readily be seen from FIG. 1.

When loading the dispenser, a portion of the strip of web material is unrolled from the roll on the support S. It is then payed over the roller means C, per example, and engaged between the hinged part 2 while separated from the fixed part 1 as the two parts are separable through hinge 3 and the strip of web material projects from an opening at the bottom of the dispenser as will be discussed in greater detail hereinafter.

After loading of the strip of web material, the hinged part 2 is arcuately brought into closed confrontation with the fixed part 2 thereby starting the corrugating process as a result of the said projections 1*c* and 2*c*. When the projecting end is pulled by hand, the corrugated strip of web material passes between the aforementioned cogwheels 4, 6 for tracking and completing the corrugations. The cogwheels are rotated to a predetermined stopping point. The strip of web material thus pulled can then be detached by means of a provided cutting means positioned internally of the dispenser, operating either by an independent manual action or by the same pulling action occurring at the end of the manual pulling stroke with respect to the opening for the passage of the strip of web material so that there is an end portion remaining in the dispenser which projects from the dispenser in order to be accessible for a further dispensing step as needed. In the latter mode of operation the tracking and drive means require only the cogwheels.

However, in another embodiment, to be hereinafter discussed, the device is fully automated to dispense discrete strips of web material, whereby, to enable the user to obtain at the end of each manual pulling operation a small length a strip of web material sufficient for grasping for the next cycle.

In order to accomplish this, a cutting means is combined with the tracking and drive means which in this embodiment include the aforementioned cogwheels 4, 6 and gears 5, 7.

Each of the cogwheels 4,6 situated at the front plate 1*a* have radially extending recesses 4*a*, 6*a*, respectively, thereby producing a relatively large gap in the teeth. An L-shaped lever 13 is rotatably mounted at 14 on cogwheel 4 and has one of its ends positioned in operable juxtaposition with swivel 15 in the recess 4*a* and is operable through oscillatory movement. A counter support jaw 16 having a U-shaped configuration is in said recess 4*a*.

Another L-shaped lever 17 is fixed onto the cogwheel 6 with one end thereof in operable juxtaposition in the recess 6*a* and to which is hinged by means of pin 18 support jaw 19 which also has a U-shaped configuration. The other end of L-shaped lever 13 has secured thereto one end of a helical spring 20 in a position where the swivel 15 is the farthest from the pin of the cogwheel 4 and 16 is also operably associated with a return spring 21.

Jaw 19 is mounted .so as to hinge freely (either on pin 18 or on a different pin situated higher up). A pinked cutting blade 22 is mounted with respect to support jaw 19 wherein the blade has one or several teeth the rearward end of which is housed in a recess 6*a*. The assembly is designed so that when the cogwheels are rotated thereby bringing the oppositely disposed jaws 16,19 into contact against the corrugated strip of web material (see FIG. 1), the said rear end of the blade against a side of the recess 6*a* or a roller, thereby causing the blade to swing in front of a return spring towards the corrugated strip of web material so as to penetrate, as and when the cogwheels are rotated, into the corrugated material. A discrete portion of the strip of web material is severed by jamming the web of strip material through the cogwheels and the tension occurring by the manual pulling step (see FIG. 4).

Figure 4D:
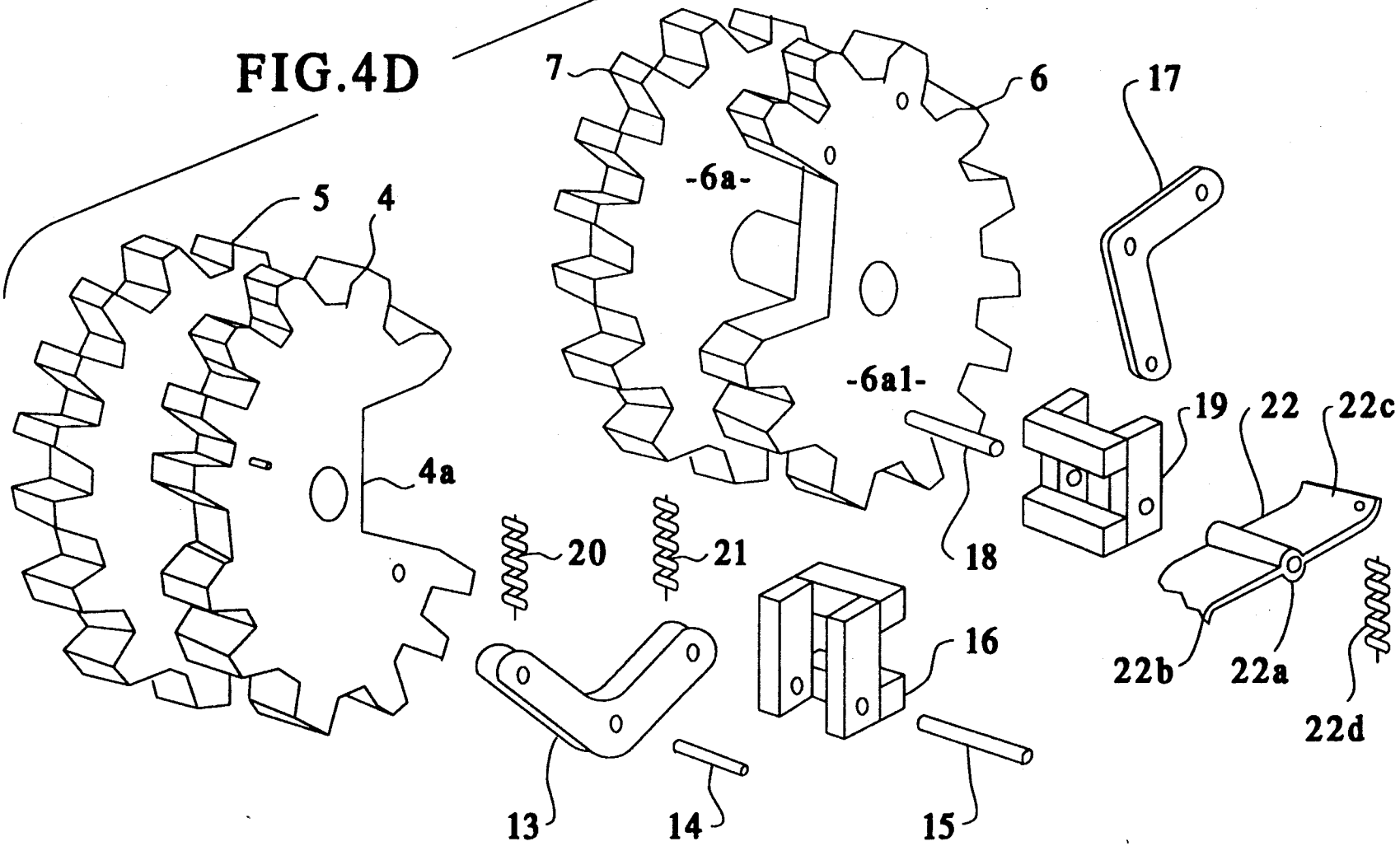
FIG. 4D is an exploded view of the tracking drive and severing parts.

Attention is now directed to FIGS. 4A, 4B, 4C and 4D taken together with FIG. 4. The support jaw 19 is articulated freely at swivel pin 18 in relation to the L-shaped lever 17, having swivel pins 17*a* and 17*b* which are secured to the cogwheel 6. The cutting blade 22 is pivotally mounted relative to the said jaw 19 by means of a boss either on the swivel pin 18 or on an independent pin located higher up than the swivel pin 18. The blade edge part 22*b* is curved and toothed; it passes between the support blocks of support jaw 19 whereas the back raised end 22*c* is supported against the lower side 6a1 of the recess 6*a* under the action of a return spring 22*d* having one end attached to cogwheel 6 as seen from the Figures.

The operation of the severing device will now be described with specific reference made to FIGS. 4, 4A, 4B, 4C.

When a person manually pulls the strip of corrugated web material extending from under the dispenser, there will be rotational movement wherein cogwheel 4 rotates clockwise and cogwheel 6 rotates counterclockwise. The beginning of this arcuate movement is seen in Figure A wherein counter support jaw 16 is articulated resiliently by the lever 13 through spring 20 and is thrust against the corrugated strip of web material as noted. At this juncture the cutting blade 22 constrained by spring 22*d* is at a distance from the corrugated strip.

As the action of manually applied traction continues as seen from FIG. 4B, the two jaws 16, 19 mounted on the cogwheels 4, 6 are clamped against the corrugated material. The latter is tensed between the blocks of said jaws while the cutting blade 22 supported by the back on the side 6a1 of the recess 6*a* and positioned by articulation of the swivel pin 18 engages the corrugated strip and penetrates it by virtue of the trajectory, which is seen to be eccentric relative to the arc described by the cogwheel 6 and of its back support.

At the end of the manual pull, see FIG. 4C, the blade 22 has traversed the corrugated strip of tensed wiping material to sever a discrete corrugated strip of web material. The said discrete strip while being severed, the cogwheels continue on the rotation to bring into a position an extended portion of additional fresh corrugated strip ready to be manually pulled to repeat the operation of dispensing.

FIG. 4D depicts an exploded view of the various parts.

Figure 5:
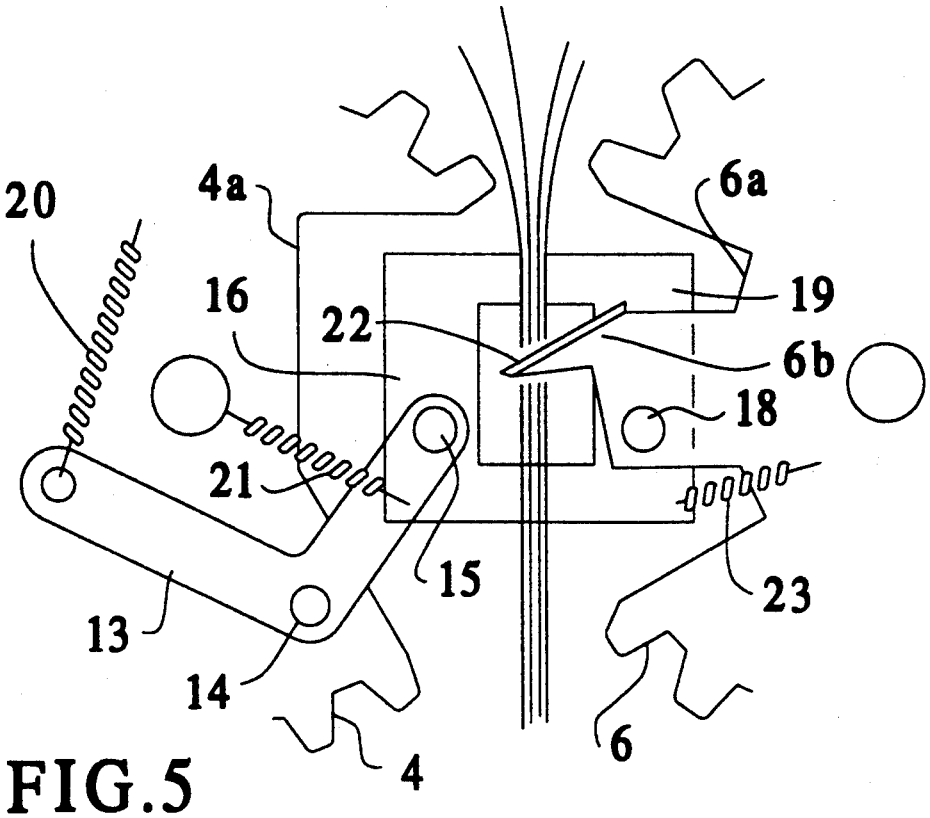
FIG. 5 is a view similar to that of FIG. 4, showing the cutting blade assembly and its operation according to another embodiment.

According to another embodiment shown in FIG. 5, the pinked cutting blade 22 is directly integral the cogwheel 6, which, for this purpose, has a projection 6*b* in the middle of the recess 6*a*. The said projection 6*b* then takes the swivel pin 18 of the jaw 19, which pivots in the said recess in front of a return spring 23 when it comes into contact with the opposite jaw 16 thus clearing the cutting blade when penetrates the corrugated web material as the cogwheels rotate.

So as not to underly mark the corrugations of the corrugated strip of web material and in order to facilitate its passage, the teeth of the cogwheels 4, 6 have wide rounded edges. This means that when the corrugated and pulled strip is severed, it is unfolded naturally and the user then has a large wiping surface.

It is also to be emphasized that the two swivel pins 14, 18 of the respective jaws are offset towards the bottom with respect to the center of the jaws in order to provide the exact confrontation of the support parts of the jaws resulting with firm clamping of the corrugated strip of web material during the cutting operation with concomitant rotating of the cogwheels.

As seen once again in FIG. 3, the gears 5, 7 are subject to the action of the spring 24 attached in an eccentric manner to store kenetic energy required for cutting and to drive the cogwheels after the pulled corrugated strip of web material in order to reposition a short portion of corrugated strip of web material out of the dispenser.

On the other hand, in order to prevent the gears from rotating backwards, one of the gears 5 or 7 cooperates with a ratchet pawl 25 which is resiliently hinged on plate 1*a*.

In order, under all circumstances to provide the projection of at least an end of the unsevered corrugated strip of web material, provision is made in at least one embodiment for rotating from the outside of the dispenser one of the gears 5 or 7. With this in mind, a lever 26 is mounted so as to resiliently pivot on plate 1*a*. The lever 26 has a free end which describes a swivelling motion and has a lever 27 designed with a profiled end 27*a* adapted to be engaged between two teeth under the manual action exerted to its other end 27*b* accessible under the dispenser, the latter being in effect a hand for rotating the gear 5 as necessary.

As heretofore discussed the corrugated strip of web material which is pulled by hand has a length corresponding to the circumference of the cogwheels. This is the situation where the cutting means are combined with the rotation of the cogwheels. In order to dispense different lengths of discrete strips, the assembly of cogwheels, gears, jaws, cutting blade is supplied in the form of interchangeable cartridges wherein the cogwheels are of differing diameters resulting in dispensing of strips of web materials over a range of lengths.

With this is in mind, the dispenser consists of four distinct parts,i.e. a fixed support A for any surface; a reel holder B component, a closing lid D and an interchangeable cassette E. The latter contains all the operating mechanisms required to drive and cut the strips of upstream produced corrugated strip of web material, i.e. by the stated conforming means and the stated projection.

Figure 9:
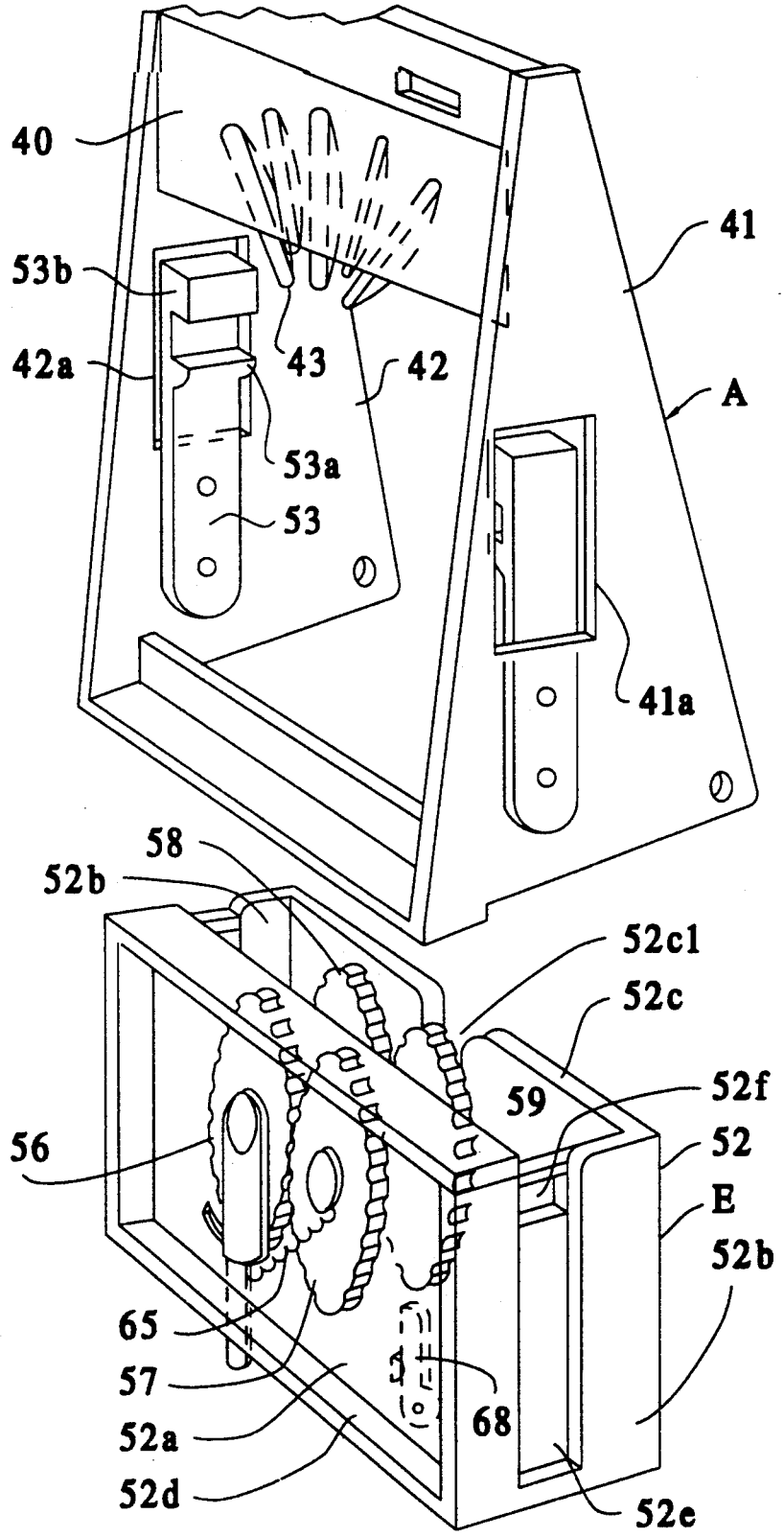
FIG. 9 is a perspective view separately illustrating a mechanism holder cartridge and the dispenser support.

Turning to FIG. 9, the support A comprises a bottom plate 40 in order to fix the dispenser and two triangular legs 41, 42. In the top part of the bottom plate there are similar projections 43 distributed for corrugated the strip of web material which are interleaved between the aforementioned complementary corrugation producing projections 44 arranged on the reel holder B component. The web material as it is payed off the reel is passed over a path reversing means and idle means 45 all in the direction of the tracking and drive means located in the cartridge E. The idler means 45 is resiliently mounted whereby to avoid the tearing of the strip of web material under the manual pulling action. In order to accomplish this, idles means 45 is mounted on a wall 46 which carries the said projections 44 and is hinged at 47 with the reel support means 48. Thereby the possibility of undue angular movement is in limited is the direction of the pulling force, see FIG. 11.

In the central part, the reel support 48 is freely rotable and retention stubs 49 for the reel of wound strip of wiping web material. The stubs 49 may be subject to adjustment to mount reels of different widths. In addition, a flange 50 is fixed whereby the reel assembly can be dismantled on one of the stubs 49 which is fitted with flexible tabs 51 applied against the support arms 48*a* in order to brake the unrolling of a fresh reel until approximately half has been unrolled thus avoiding loops to form due to pulling the strip of web material.

The interchangeable cartridge E is made up of a parallelepiped box 52 comprising a rear side 52*a*, two sides 52*b*, a front wall 52*e* with a central opening 52*c* 1 for the passage of the strip, and a bottom 52*d*. The top portion is open. The said sides have a slot at the top part preferably offset in the width with an opening 52*f* in the proximity of the said part.

Side clamps 53 are fixed at their respective bottom and middle part on the internally faces of the triangular legs 41, 42 of support A so as to engage by guided sliding, the cartridge by its slots 52*e* until the openings 52*f* abut against profiled projections 53*a* situated near the top end of the slideways. Rectangular openings 41*a*, 42 are located on the legs at the same level as the top part of the side clamps, thus allow, when the cartridge is pushed, the side clamps to swivel out to this area and engage projections 53*a* into openings 52f thus locking the cartridge by resilient thrust of the side clamps (see FIG. 9).

Figure 11:
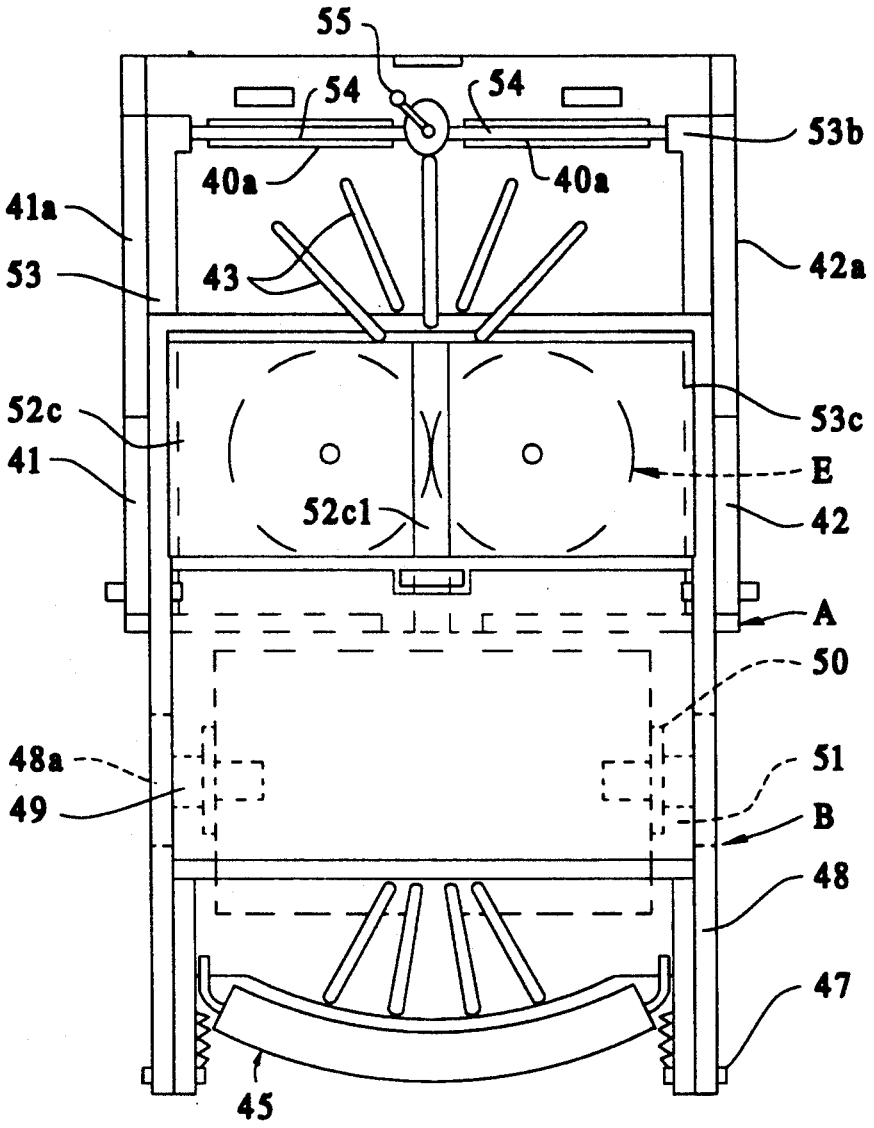
FIG. 11 is a front view of the dispenser with a reel holder and conforming means in a lowered position.
Figure 10:
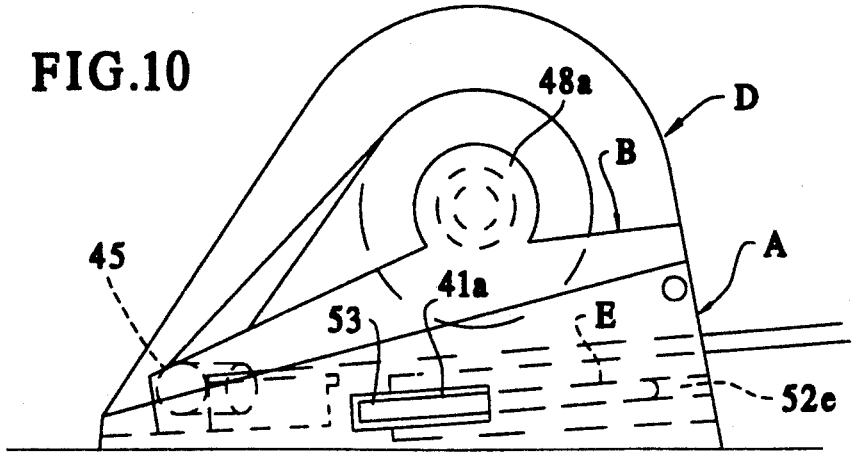
FIG. 10 is a side view schematically showing the unit according to the invention on a horizontal surface.

At the top end, the slideways have solid knobs 53*b* to unlock the cartridge by hand by spreading apart the clamps 53. In order to prevent the cartridge or cassette from falling and to facilitate operations a device to free the cartridge with one hand is provided, while the other hand can hold the released cartridge. For example, as illustrated in FIG. 11, the slideways 53 are extended beyond projections 53*a* up to the proximity of the top portions of the legs 41, 42 of the support. The bottom plate 40 has parallel guides 40*a* transversably thereto in which bars 54 are engaged and guides are somewhat shorter than bars 54 which as a result permits guides 40*a* to slide to and for.

Between the said bars 54 there is an eccentric lever 55 adapted to arcuately move on the bottom plate. The lever 55 enables as a result of a 90° angular movement, to effect a simultaneous separation of the slideways which is retained in the rectangular openings 41*a*, 42*a*. The cartridge is thereby unlocked at the same level as projections 53*a* and opening 52*f*.

Between the front 52*c* and rear 52*a* faces of the cartridges there are two sets of coaxial toothed wheels for tracking and driving the corrugated strip of web material upstream and passing between the two. However, in order to improve the operating conditions, the two sets of toothed wheels are made with different modules. At the rear, the cogwheels 56, 57 with a full set of teeth comprise a smaller module than those of the drive gears 58, 59. In this way, cogwheels mesh together without backlash, whereas the gears mesh together with backlash enabling passage without the corrugated strip of web material becoming jammed and maintaining the support jaws 60 and counter support 61 correctly, face to face without sliding, being resiliently hinged mounted on a fixed support 62 and a movable support 63 connected to the gears 58, 59 at the level of the recesses 58*a*, 59*a*.

On the other hand, the gears 58, 59 have beveled edge portions on the external sides which facilitates the engagement of the corrugated strip of web material when loading the dispenser; whereas the inside of the teeth are grooved.

According to another feature, the drive of the corrugated strip is improved by special fittings to the jaws, i.e. micro-asperities on the faces opposite at least one jaw, a projection 61*a* formed at the bottom internal part of the counter support jaw 61 which pushes the corrugated strip of web material inside the support jaw and a center separation 61*b* formed in the top internal part to maintain the corrugated strip between the two teeth of the cutting blade 64 mounted in a fixed manner on the jaw 60. It can be seen once again between the cogwheels 56, 57 at the top and bottom that there are triangular areas in relief 52a1 on the rear face of the cartridge in order to prevent the corrugated strip from being engaged in the cogwheels and tracking it in the direction of the outlet F.

When the projecting corrugated strip has been pulled and cut between the two jaws (FIG. 14), the sets of cogwheels and gear wheels which are urged by a spring 65 attached eccentrically (FIG. 9) on the pin of the gear wheel 59 continue to rotate in order to enable the outlet of a new strip ready to be pulled. At the end of the stroke, a finger 61*c* of the jaw 61 turns the vertical arm 66*a* of a lever 66 hinged on the front wall 52*c* of the cartridge, and the other perpendicular arm 66*b* of the lever is engaged between the cogwheel 57 and gear 59 in order to abut against a projection 67 when the finger 61*a* escapes from the arm 66*a* and thus stops the cogwheels and gears. The lever 66, returned by means of a spring, comes back to its initial position and the projection 61*a* of the jaw 61 is applied against a non-return ratchet pawl 68.

The outlet F of the corrugated strip of web material is delimited by a funnel formed in a triangle 52c1 of two sloped walls 69, two side idler rollers 70 supported by walls 52*a*, 52*c* and a third front idler roller 71 supported by the reel holder B.

Finally, a auxiliary lever device with a pawl ratchet 72 operates on one of the cogwheels in order to make the corrugated strip of material project when loading the unit.

On the other hand, the rolls of wiping material can be of different widths in order for the dispenser to accept several sizes, reel centering components are provided which are adjustable in distance (by screwing or unscrewing in particular) or interchangeable like those illustrated in FIG. 7 where the said components 28 and 29 can be either put one behind the other with an inserted sideplate or disassociated thus obtaining three distinct distances and furthermore due to the resiliently of the arms.

Figure 6:
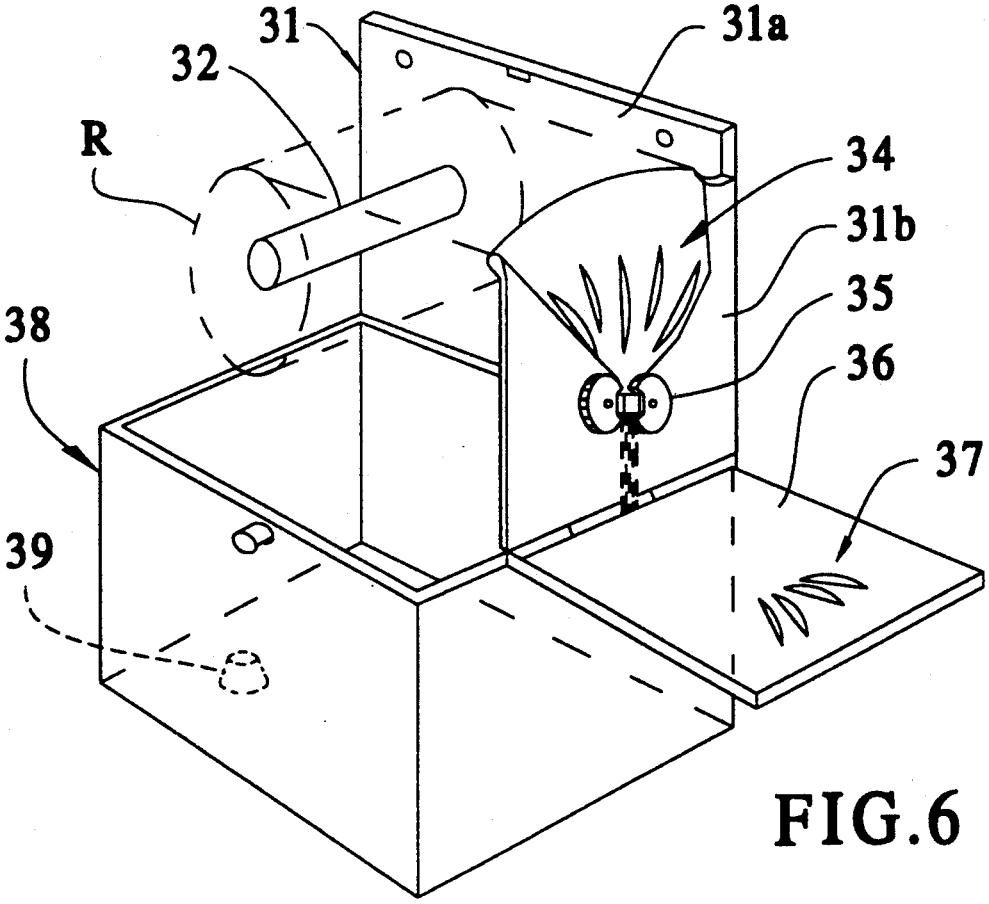
FIG. 6 is a very schematic perspective view illustrating another embodiment of the dispenser.

Considering certain dimensioning requirements, it may be necessary to provide another layout for the various components of the dispenser. Another form of embodiment for the unit has been schematically illustrated in FIG. 6.

In this case, the fixed part 31 for connection with a vertical support is comprised of a bottom plate 31*a* and a perpendicular side plate 31*b*. The bottom plate perpendicularly receives the reel of web material by a core 32, whereas the side plate supports on the inside and at the top, the return means and the conforming component 33 for the strip, on the outside, a part of projections 34 to corrugate the strip and means 35 to track and drive the corrugated strip of web material, with the cutting components if required. On the outside of the bottom there is a side plate which takes, in a hinged manner, a plate 36 which supports the complementary part 37 with the corrugating projections and which enable the corrugated strip the pass with a view to it being pulled by hand.

Finally, a closing lid 38 is provided which is fitted with a reel support component 39 which retains the plate 36 against the side plate 31*b*.

The advantages are clearly apparent from the description. It is important to emphasize the possibility of dispensing any type of wiping material even the most fragile due its being dispensed in a corrugated bunched fashion which modifies the tensile strength and thus avoids untimely tearing when the user has wet hands.

One can also mention the possibility of using materials of different lengths, due to the fact of the adjustment of the distance afforded reel support. Important is also the face that variable lengths of corrugated strips may be dispensed in view of the interchangeable cartridges. The corrugated wiping material may be naturally unfolded enabling efficient use. The interchangeable cartridges contain all of the operative mechanism which enable the easy dispensing of variable lengths of materials in accordance with diameter of the cogwheels and gears. The dispenser also operates in any position, whereby the corrugated strip of web material may be pulled from the dispenser outwardly in any direction.

I claim:

1. A device for manually dispensing and cutting discrete longitudinally corrugated web materials from an elongated web comprising:

support means, wall means dependingly hinged from said support means, the support means and the wall means together define a housing, elongated web support means disposed on one side of said wall means, a plurality of elongated spaced first projections defining a fan configuration affixed to the other side of said wall means, a plurality of elongated spaced second projections defining a fan configuration affixed to said support means, said first projections and said second projections positioned whereby the said projections interleave in spaced relationship when said dependingly hinged wall means is arcuately moved into operative confronting relationship with said support means, guide roll means positioned transverse with respect to said first and second projections when said depending hinged wall means is in confronting relationship with said support means adapted and constructed to guide said elongated web from said support means to between the spaces of said projections, and to longitudinally corrugated said elongated web, a pair of cooperatively journalled intermeshing cogwheels positioned transverse to said first and second projections on the side opposite to said guide rolls adapted and constructed to receive therebetween said corrugated elongated web as it is payed from said elongated web support means, each of said cogwheels having cooperatively disposed radial recesses and being oppositely rotated when said elongated web passes therebetween, each of said cogwheels having a cooperatively disposed recess, each of said recesses having jaw means adapted and constructed to pinch therebetween said corrugated elongated web when said jaws are in confrontation and said corrugated elongated web is therebetween, severing means associated with said jaw means adapted and constructed to at least partially sever the corrugated elongated web to thereby define discrete portions of elongated longitudinally corrugated web, each cogwheel is keyed to separated parallelly disposed axles, including gears mounted on each of said axles displaced from each of said cogwheels, and in intermeshing relationship, and kinetic energy storage means loaded when said elongated longitudinally corrugated web is manually pulled from between said cogwheels and unloaded when said discrete portion of elongated longitudinally corrugated web is severed, each end of said axles being journalled in a removable cartridge, said housing having internal catch means for holding said removable cartridge, said removable cartridge having cooperating retention means to releasably engage said catch means, said housing having an opening at an end portion opposite to said projections dimensioned whereby said removable cartridge may be selecetively passed into and out of said housing into either retaining engagement or out of retaining engagement in said housing as desired.

2. The device according to claim 1 wherein the removable cartridge includes parallelly disposed side walls and each of said axles are journalled therein, said removable cartridge includes parallelly disposed end walls, said end walls have mounted thereon said cooperating retention means for engagement with said catch means.

3. In a device for manually dispensing and cutting discrete longitudinal corrugated web materials from an elongated web comprising:

housing means cartridge means removably mounted in said housing means means for paying said elongated web material in an elongated corrugated manner into said cartridge means, said cartridge means having rotably journalled therein a pair of cooperatively journalled intermeshing cogwheels adapted and constructed to receive therebetween said elongated corrugated web material, each of said cogwheels having cooperatively disposed radial recesses and being oppositely rotated when said elongated corrugated web passes therebetween, each of said cogwheels having a cooperatively disposed recess, each of said recesses having jaw means adapted and constructed to pinch therebetween said corrugated elongated web when said jaws are in confrontation and said corrugated elongated web is therebetween, severing means associated with said jaw means adapted and constructed to at least partially sever the corrugated elognated web to thereby define discrete portions of elongated longitudinally corrugated web, each cogwheel is keyed to separated parallelly disposed axles, including gears mounted on each of said axles displaced from each of said cogwheels, and in intermeshing relationship, and kinetic energy storage means loaded when said elongated longitudinally corrugated web is manually pulled from between said cogwheels and unloaded when said discrete portion of elognated longitudinally corrugated severed.

4. The device of claim 3 wherein the said housing has internal catch means for holding said removable cartridge, said removable cartridge has cooperating retention means to releasably engage said catch means, said housing has an opening at an end portion opposite to said projections dimensioned whereby said removable cartridge may be selectively passed into and out of said housing into either retaining engagement or out of retaining engagement in said housing as desired.

5. The device according to claim 4 wherein the removable cartridge includes parallelly disposed side walls and each of said axles are journalled therein, said removable cartridge includes parallelly disposed end walls, said end walls have mounted thereon said cooperating retention means for engagement with said catch means.

* * * * *